US010376110B2

(12) United States Patent
Hall

(10) Patent No.: US 10,376,110 B2
(45) Date of Patent: Aug. 13, 2019

(54) HAND TOWEL DISPENSER

(71) Applicant: KINGSWAY ENTERPRISES (UK) LIMITED, Swanley, Kent (GB)

(72) Inventor: Benjamin Hall, Swanley (GB)

(73) Assignee: Kingsway Enterprises (UK) Limited, Kent (GB)

( * ) Notice: Subject to any disclaimer, the term of this patent is extended or adjusted under 35 U.S.C. 154(b) by 0 days.

(21) Appl. No.: 16/017,119

(22) Filed: Jun. 25, 2018

(65) Prior Publication Data

US 2019/0008336 A1 Jan. 10, 2019

(30) Foreign Application Priority Data

Jul. 10, 2017 (GB) ..... 1711072.7

(51) Int. Cl.
*A47K 10/42* (2006.01)
*A47K 10/20* (2006.01)
*A47K 10/32* (2006.01)

(52) U.S. Cl.
CPC ..... *A47K 10/424* (2013.01); *A47K 10/20* (2013.01); *A47K 2010/3233* (2013.01); *A47K 2010/3246* (2013.01)

(58) Field of Classification Search
USPC ..... 221/33–63
See application file for complete search history.

(56) References Cited

U.S. PATENT DOCUMENTS 283,072 A 8/1883 Camp
1,161,564 A 11/1915 Wheeler
2,171,415 A 8/1939 Haney
2,216,323 A 10/1940 Ringler
6,003,723 A 12/1999 Morand
6,050,448 A * 4/2000 Willis ..... G07F 11/04 221/154
6,877,634 B2 * 4/2005 Tramontina ..... A47K 10/424 221/311
7,845,515 B2 * 12/2010 Moody ..... A47K 10/424 221/36

(Continued)

FOREIGN PATENT DOCUMENTS

JP H724198 U 5/1995
JP 2009029511 2/2009

OTHER PUBLICATIONS

Great Britain Application 1711072.7 Search Report dated Jan. 8, 2018.

*Primary Examiner* — Jacob S. Scott
*Assistant Examiner* — Ayodeji T Ojofeitimi
(74) *Attorney, Agent, or Firm* — Erise IP, P.A.

(57) ABSTRACT

An apparatus for storing hand towels, the apparatus comprising a receiving portion for receiving hand towels, a first retaining member comprising a first retaining portion, the first retaining portion defining a first retaining surface for retaining the hand towels within the receiving portion, a second retaining member comprising a second retaining portion, the second retaining portion defining a second retaining surface for retaining the hand towels within the receiving portion, wherein the first and second retaining members define an opening for providing access to the hand towels and wherein an angle between the first and second retaining surfaces is less than 180 degrees.

12 Claims, 9 Drawing Sheets

(56) References Cited

U.S. PATENT DOCUMENTS

2006/0261076 A1* 11/2006 Anderson ..... A47K 10/3818
221/33
2015/0313425 A1* 11/2015 Thoren ..... A47K 10/36
221/1

* cited by examiner

HAND TOWEL DISPENSER

RELATED APPLICATION

This application claims priority to Great Britain Patent Application 1711072.7 filed Jul. 10, 2017, the disclosure of which is incorporated herein by reference.

FIELD

The present disclosure relates to hand towel dispensers for use in healthcare applications. In particular, it relates to hand towel dispensers where an anti-ligature function is required, for example in a psychiatric ward.

BACKGROUND

To ensure the safety of patients in healthcare environments, for example psychiatric wards, fixtures and furniture items need to provide a number of different functions. For example, a hand towel dispenser for use in a kitchen, bathroom or toilet should reduce, or prevent entirely, the possibility of a patient attaching a ligature with which they could harm themselves. This applies to all hand towel dispensers in such an environment, which should also perform their usual functions of allowing easy access to hand towels and easy replacement of stock when required.

SUMMARY

In accordance with an aspect of the disclosure there is provided an apparatus for storing hand towels, the apparatus comprising a receiving portion for receiving hand towels, a first retaining member comprising a first retaining portion, the first retaining portion defining a first retaining surface for retaining the hand towels within the receiving portion, a second retaining member comprising a second retaining portion, the second retaining portion defining a second retaining surface for retaining the hand towels within the receiving portion, wherein the first and second retaining members define an opening for providing access to the hand towels and wherein an angle between the first and second retaining surfaces is less than 180 degrees.

The angle between the first and second retaining surfaces may be between 60° and 150°, more preferably between 75° and 115°. For example, in use the angle of each of the first and second retaining surfaces to the horizontal may be between 15° and 60°. The angle between the first and second retaining surfaces may be 90°. For example, in use each of the first and second retaining surfaces may be at an angle of 45° to the horizontal.

The apparatus may further comprise a housing for defining the receiving portion. The housing may comprise an opening for receiving towels in the receiving portion. The first and second retaining members may be disposed within the housing. The apparatus may further comprise a locking mechanism configured to retain the housing in a closed position. The housing may comprise a cut out for receiving a latch of the locking mechanism.

At least one of the first and second retaining members may comprise a base portion for providing a sealed underside of the apparatus. The base portion may be formed integrally with the retaining portion of the retaining member. An edge between the base portion and the retaining portion may define the opening for providing access to the hand towels.

The apparatus may further comprise a cover for covering at least the receiving portion. The first retaining member may comprise at least one locating surface for mating with the cover. The at least one locating surface may be disposed at an obtuse angle to the retaining surface of the first the first retaining member. In use, an upper surface of the cover may slope downwards in a direction from the back of the apparatus towards the front of the apparatus.

The apparatus may comprise a mounting plate for mounting the hand towel dispenser to a wall.

At least one of the first retaining member, the second retaining member, the cover and the housing may formed by folding a flat sheet. Any corresponding open edges of the flat sheet may be joined by welding.

BRIEF DESCRIPTION OF THE DRAWINGS

Exemplary embodiments of the disclosure shall now be described with reference to the drawings in which.

Throughout the description and the drawings, like reference numerals refer to like parts.

DESCRIPTION

Figure 1:
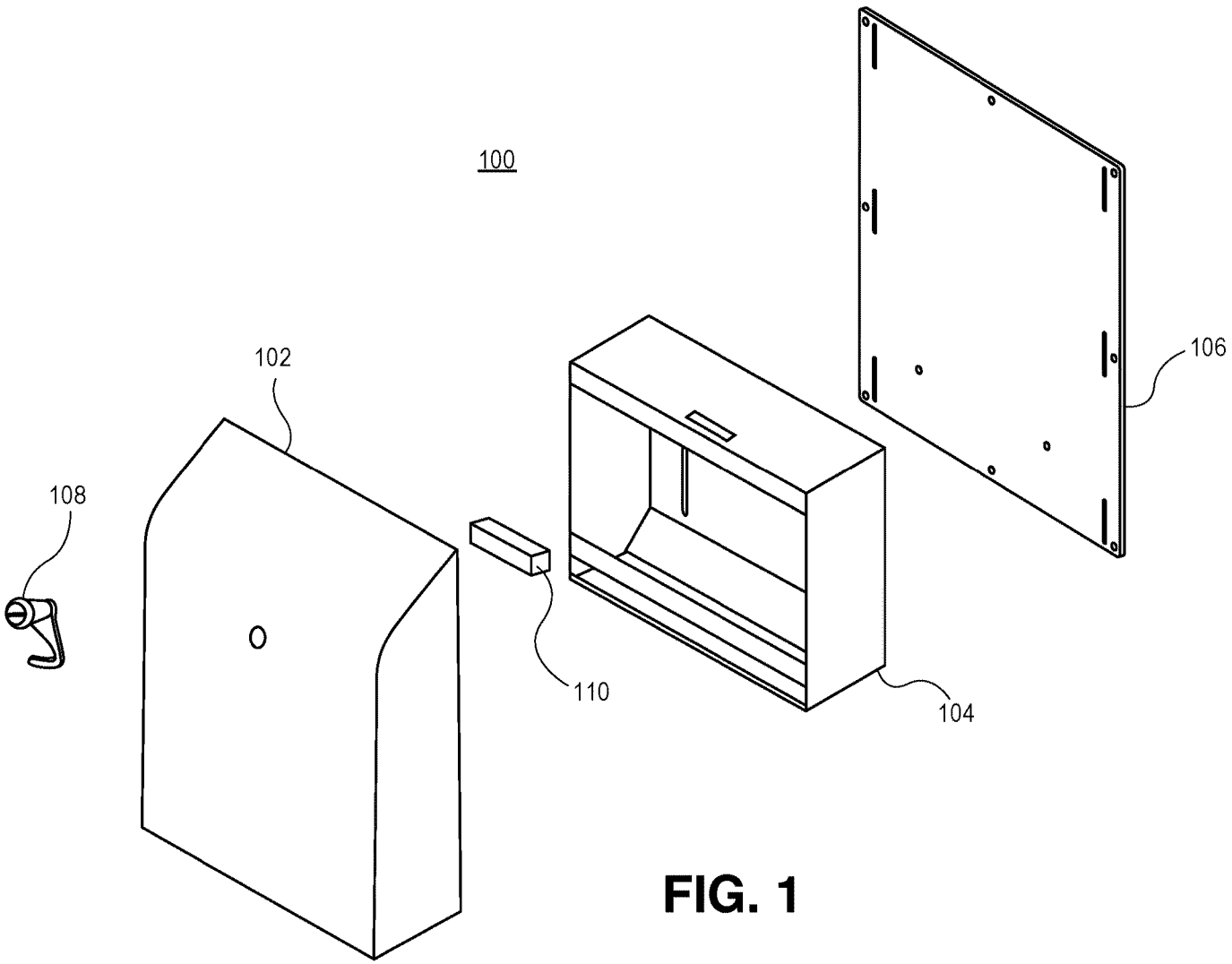
FIG. 1 shows an exploded view of a hand towel dispenser according to the present disclosure.

FIG. 1 shows an exploded view of a hand towel dispenser 100 according to the present disclosure. The dispenser 100 comprises a cover 102, a cassette assembly 104, a mounting plate 106, a locking mechanism 108 and a lock shroud 110. When assembled, hand towels are placed within the cassette assembly 104, which is closed by the cover 102 and attached to a wall via the mounting plate 106. The cassette assembly 104 has an opening allowing a user to access hand towels, as will be described in more detail below.

Figure 2:
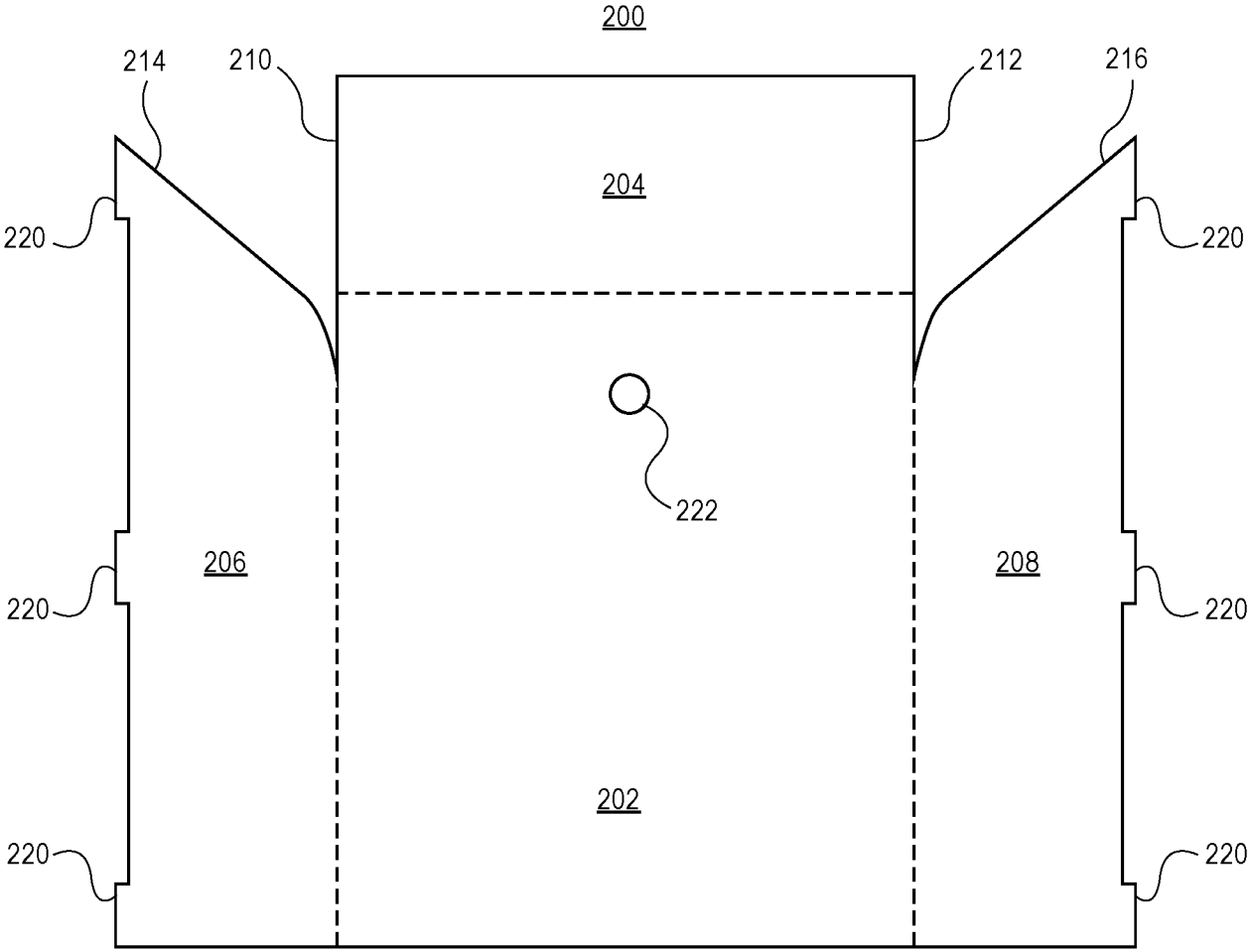
FIG. 2 shows a schematic view of a net for forming a cover of a hand towel dispenser according to the present disclosure.

As shown in FIG. 2, the cover 102 is formed from a flat sheet. The sheet is cut into a net 200 comprising a front face 202, a top face 204 and two side faces 206, 208. The net 200 is folded along the borders of the front face 202 with each of the other faces. The angle of folding is preferably 90° for the folds of the side faces 206 and 208. The open edges 210 and 212 of the top face 204 are joined to the corresponding open edges 214 and 216 of the side faces 206 and 208 respectively, forming the cover. The side faces 206, 208 each have three tabs 220 for attaching the cover 102 to corresponding slots in the mounting plate 106, as will be described in more detail in relation to FIG. 7. Three tabs 220 are shown on each side face 206, 208, but it will be appreciated that any suitable number of tabs 220 could be used. When assembled, the tabs 220 are tack welded into corresponding slots in the mounting plate 106 and finished flush to avoid any overhang. The front face 202 also has an opening 222 for provision of a locking mechanism 108, as will be described in more detail in relation to FIG. 8*a*. The assembled cover 102 is shown in FIG. 1. When assembled and in use, the top face 204 is sloped, which can reduce the risk of a ligature being attached to the cover 102.

Figure 3:
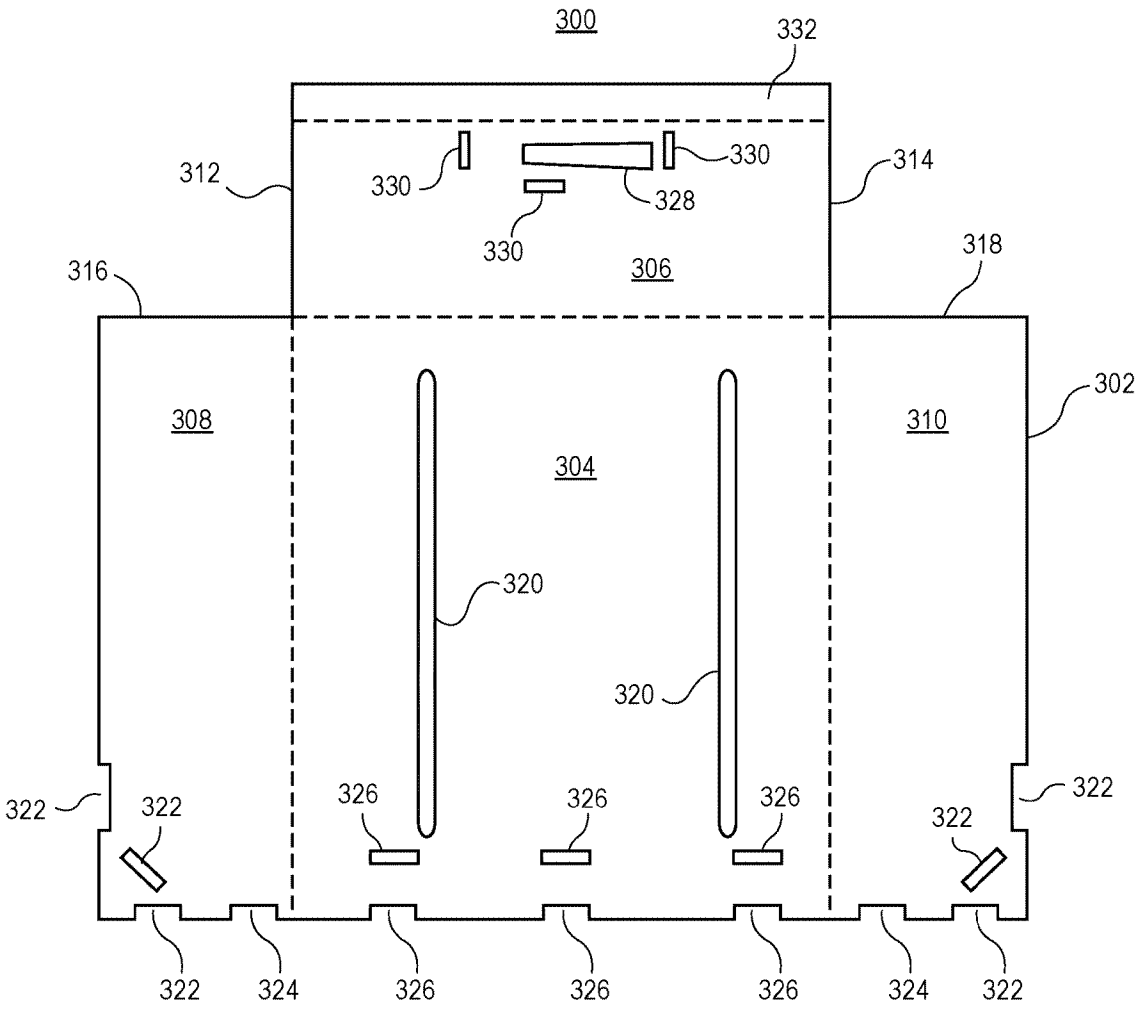
FIG. 3 shows a schematic view of a net for forming a cassette body of a hand towel dispenser according to the present disclosure.

As shown in FIG. 3, the cassette body 300 of the cassette assembly 104 is similarly formed from a flat sheet. The flat sheet is cut into a net 302 comprising a back face 304, a top face 306 and two side faces 308, 310. The net 302 is folded along the borders of the back face 304 with each of the other faces. The angle of folding is preferably 90° for all folds. The open edges 312 and 314 of the top face 306 are joined to the corresponding open edges 316 and 318 of the side faces 308 and 310 respectively, forming the cassette body 300. When assembled, the cassette body 300 fits inside the cover 102. The interior of the cassette body 300 provides a receiving portion which can receive and store hand towels when the dispenser 100 is in use. Hand towels may be inserted into the cassette body 300 through its open front face and removed through its open bottom face.

The back face 304 has slots 320, running generally in a direction from top to bottom of the face, for attaching the cassette assembly 104 to the mounting plate 106 when the dispenser 100 is assembled, as will be described in more detail in relation to FIG. 7. Two slots are shown, but it will be appreciated that any suitable number of slots could be used. The side faces 308, 310 each have three slots 322 for attaching a first cassette lip to the cassette body 300 via corresponding tabs, as will be described in more detail in relation to FIGS. 4*a* and 4*b*, and a slot 324 for attaching a second cassette lip to the cassette body 300 via a corresponding tab, as will be described in more detail in relation to FIGS. 5*a* and 5*b*. The back face 304 has six slots 326 for attaching the second cassette lip to the cassette body 300 via corresponding tabs, as will also be described in more detail in relation to FIGS. 5*a* and 5*b*. It will be appreciated that any suitable number of slots could be used for these attachments.

The top face 306 has an opening 328 for receiving a latch of the locking mechanism 108 to hold the cassette assembly 104 in position, and three slots 330 for attaching the lock shroud 110 to the cassette body 300 via corresponding tabs, as will be described in more detail in relation to FIGS. 8*a* and 8*b*. Three slots 330 are shown, but it will be appreciated that any suitable number of slots could be used.

The net 302 further comprises a flange 332. The net 302 is folded along the edge of the top face 306 to form the flange 332. The angle of the fold is 90°. The flange 332 provides strength to the assembled dispenser 100. The flange 332 may also be offset from the side faces 308, 310 to provide a surface for the lock shroud 110 to rest against when the dispenser 100 is assembled.

Figure 4A:
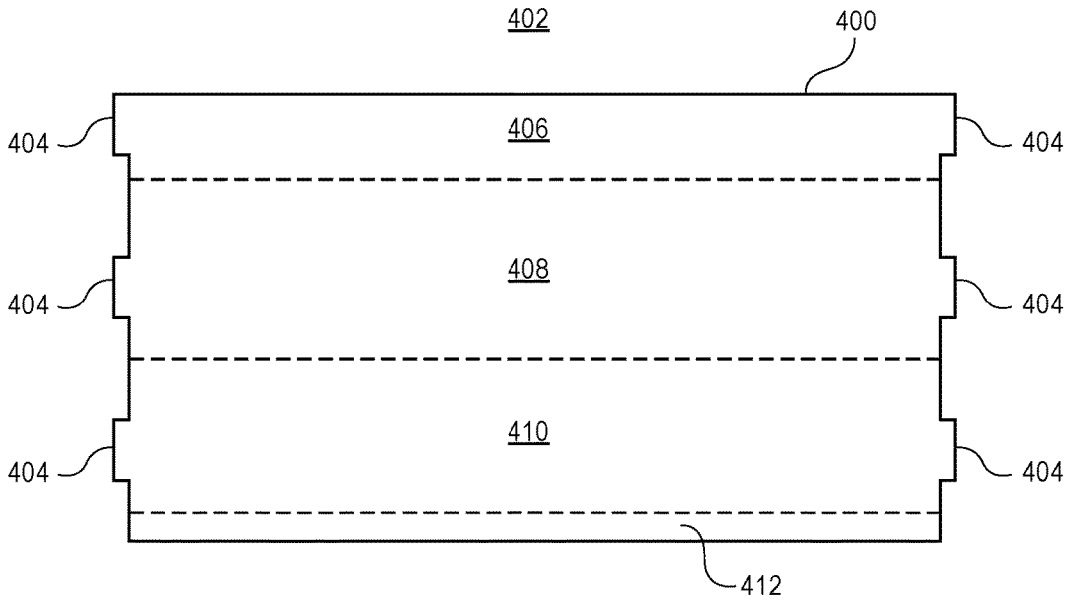
FIG. 4*a* shows a schematic view of a net for forming a first cassette lip of a cassette body according to the present disclosure.
Figure 4B:
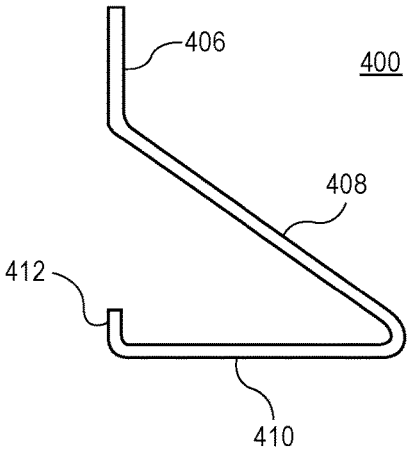
FIG. 4*b* shows a cross-sectional view of a first cassette lip of a cassette body according to the present disclosure.

As shown in FIG. 4*a*, a first cassette lip 400 is formed from a flat sheet. The sheet is cut into a net 402. The net 402 is generally rectangular with tabs 404 for inserting into corresponding slots 322 in the side faces 308, 310 of the cassette body 300. As shown in FIG. 4*b*, which is a cross-sectional view of the assembled first cassette lip 400, the net 402 is folded along three lines generally parallel to its longest dimension to provide a first cassette lip 400 with four principal portions: a first locating portion 406, a retaining portion 408, a base portion 410 and a second locating portion 412. The first and second locating portions 406, 412 provide a surface for the cover 102 110 to rest against when the dispenser 100 is assembled and provide strength to the assembled dispenser 100. The retaining portion 408 is configured to retain hand towels in the receiving portion provided by the interior of the cassette assembly 104. The retaining portion 408 is disposed at an obtuse angle to the first and second locating portions 406, 412 and at an acute angle to the base portion 410. The tabs 404 are provided on each side of the first locating portion 406, the retaining portion 408 and the base portion 410.

Figure 5A:
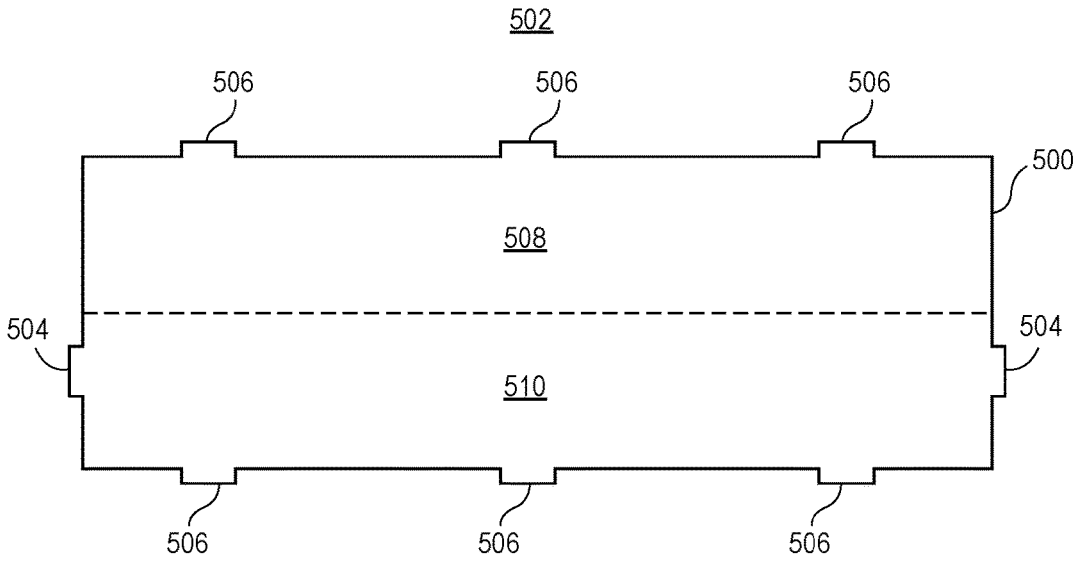
FIG. 5*a* shows a schematic view of a net for forming a second cassette lip of a cassette body according to the present disclosure.
Figure 5B:
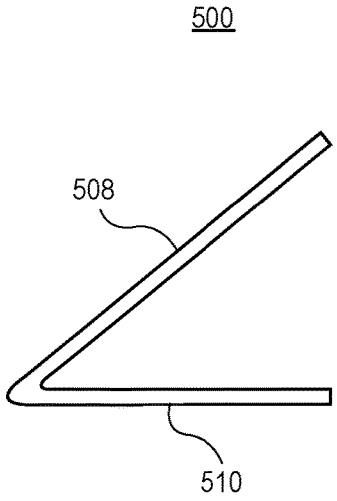
FIG. 5*b* shows a cross-sectional view of a second cassette lip of a cassette body according to the present disclosure.

As shown in FIG. 5*a*, a second cassette lip 500 is also formed from a flat sheet. The sheet is cut into a net 502. The net 502 is generally rectangular with tabs 504 for inserting into corresponding slots 324 in the side faces 308, 310 and tabs 506 for inserting into corresponding slots 326 in the back face 304 of the cassette body 300. As shown in FIG. 5*b*, which is a cross-sectional view of the assembled second cassette lip 500, the net 502 is folded along a line generally parallel to its longest dimension to provide a second cassette lip 500 with two principal portions: a retaining portion 508 and a base portion 510. As with the first cassette lip 400, the retaining portion 508 is configured to retain hand towels in the receiving portion provided by the interior of the cassette assembly 104. The retaining portion 508 is disposed at an acute angle to the base portion 510. The tabs 504 are provided on each side of the base portion 510, and the tabs 506 are provided on the long edges of the retaining portion 508 and the base portion 510.

Figure 6:
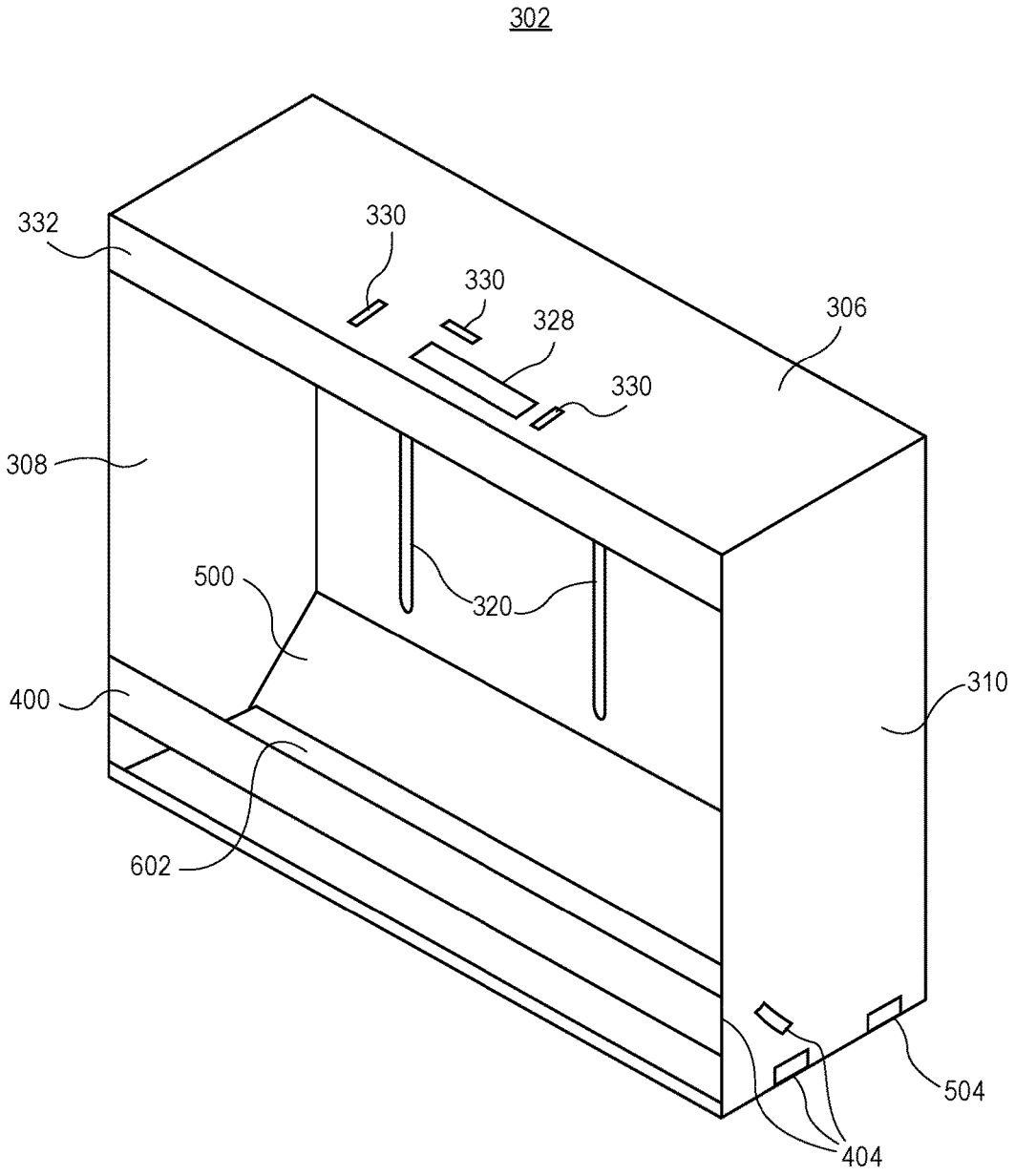
FIG. 6 shows a cassette assembly of a hand towel dispenser according to the present disclosure.

The first cassette lip 400 and the second cassette lip 500 are inserted into the cassette body 300 to provide the cassette assembly 104, as shown in FIG. 6. When assembled, the two cassette lips 400, 500 partially close the open bottom face of the cassette body 300 and provide a hand towel opening 602 for a user to access hand towels in the cassette assembly 104. The first and second cassette lips 400, 500 are assembled in the cassette body 300 such that the respective folded edges between the retaining portions 408, 508 and the base portions 410, 510 face each other and define the opening 602 for a user to access hand towels in the cassette assembly 104. The base portions 410, 510 provide a sealed underside once the cassette assembly 104 is assembled with the cover 102. The retaining portions 408, 508 extend towards the centre of the open bottom face of the cassette body 300 and serve to retain hand towels in the receiving portion provided by the interior of the cassette assembly 104, and prevent them from falling out of the cassette assembly 104, when the dispenser is in use. The retaining portions 408, 508 also extend away from the receiving portion provided by the interior of the cassette body 300. In this way, hand towels may be removed individually from the dispenser 100 and, should a ligature be inserted into the cassette assembly 104 via the opening 602, it will slide down the retaining portions 408, 508 and out of the cassette assembly 106.

The angle between the retaining portion 408 of the first cassette lip 400 and the retaining portion 508 the second cassette lip 500 is less than 180°. The angle between the retaining portions 408, 508 and their respective base portions 410, 510 is preferably between 15° and 60°. As such, the angle between the retaining portions 408, 508 and the corresponding wall of the cassette body 300 is preferably between 120° and 165°. Moreover, the angle between the retaining portion 408 and retaining portion 508 may be between 60° and 150°. The retaining portions 408, 508 may be symmetrical around a vertical plane passing through the opening 602.

In one preferred embodiment, the angle between the retaining portions 408, 508 and their respective base portions base portions 410, 510 is 45°. As such, the angle between the retaining portions 408, 508 and the corresponding wall of the cassette body 300 is 135° and the angle between the retaining portion 408 of the first cassette lip 400 and the retaining portion 508 the second cassette lip 500 is 90°.

Figure 7:
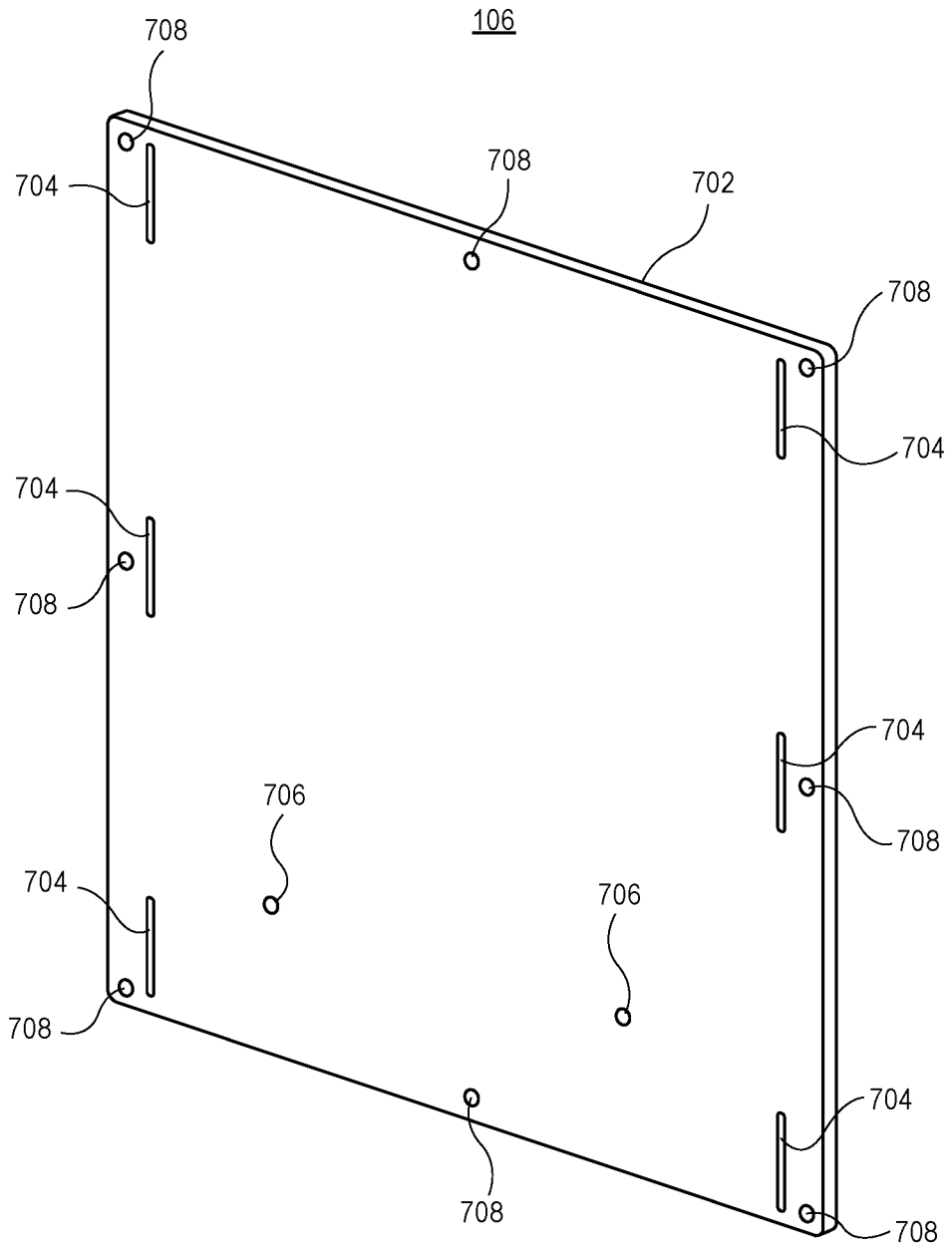
FIG. 7 shows a mounting plate of a hand towel dispenser according to the present disclosure.

As shown in FIG. 7, the mounting plate 106 comprises a generally flat sheet 702 via which the cover 102 and the cassette assembly 104 are mounted to a wall. The mounting plate has a number of slots 704 to receive corresponding tabs 220 of the cover 106, as described above in relation to FIG. 2. Six slots 704 are shown, but any suitable number of slots 704 and tabs 220 could be used. The mounting plate 106 also has through holes 706, corresponding to the position of the slots 320 in the back face 306 of the cassette assembly 104. The through holes 706 may receive mechanical attachment means, such as nuts and bolts for attaching the cassette assembly 104 to the mounting plate 106. When assembled, two retaining screws are fixed through the slots 320 and into the through holes 706. This allows the cassette assembly 104 to drop down when the locking mechanism 108 is opened and be held by the retaining screws without falling to the floor. The mounting plate 106 also has through holes 708 for receiving mechanical attachment means, such as screws, to attach the mounting plate 106 to the wall. When assembled, the mechanical attachment means may be ground flush to the mounting plate 106 to reduce the ligature risk provided by the attachment means. Nine through holes 708 are shown, but it will be appreciated that any suitable number of through holes could be used. It will be appreciated that other attachment means, such as adhesive, could be used to attach the mounting plate 106 to the wall. The mounting plate 106 has rounded corners and is chamfered around its edges, in order to reduce the ligature risk provided by the thickness of the plate itself.

Figure 8A:
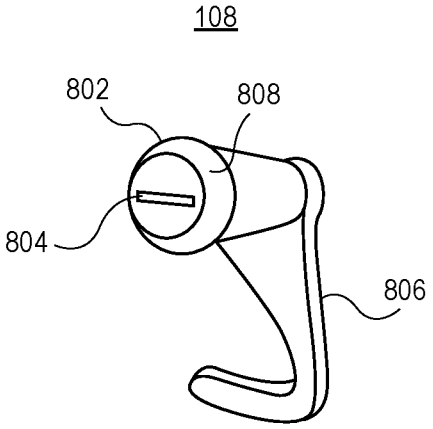
FIG. 8*a* shows a locking mechanism of a hand towel dispenser according to the present disclosure.

FIG. 8*a* shows the locking mechanism 108. The locking mechanism 108 is a locking mechanism known in the art, comprising a lock head 802, a keyhole 804 and a latch 806. The locking mechanism 108 may be a pin tumbler lock, a wafer tumbler lock, or any other suitable type of locking mechanism. The locking mechanism 108 is assembled through the opening 222 in the front face 202 such that the lock head 802 and keyhole 804 are accessible from the one side of the cover 102, with the latch 806 on the other side of the cover 102. The lock head 802 has a circumferential face 808 that is tapered such that a ligature cannot be attached to it. The locking mechanism 108 is also assembled such that, when moved from an unlocked position to a locked position, the latch 806 is inserted through the opening 328 in the top face 306 of the cassette body 300. In the locked position, the latch 806 sits inside the lock shroud 110 and acts against the underside of the top face 306 of the cassette body 300 to hold the cassette body 300 in position. When the locking mechanism 108 is opened, the latch 806 no longer holds the cassette body 300 in position and the cassette body 300 slides downwards, guided by the interaction between the retaining screws and the slots 320, until the tops of the slots 320 rest on the retaining screws.

Figure 8B:
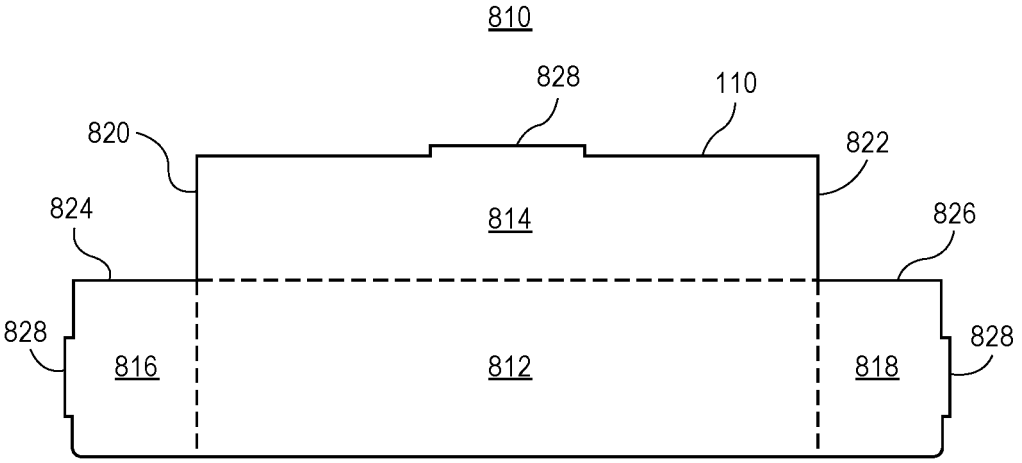
FIG. 8*b* shows a lock shroud of a hand towel dispenser according to the present disclosure.

As shown in FIG. 8*b*, the lock shroud 110 is formed from a flat sheet. The sheet is cut into a net 810 comprising a bottom face 812, a back face 814 and two side faces 816, 818. The net 810 is folded along the borders of the bottom face 812 with each of the other faces. The angle of folding is preferably 90° for all folds. The open edges 820 and 822 of the back face 814 are joined to the corresponding open edges 824 and 826 of the side faces 816 and 818 respectively, forming the lock shroud 110. The lock shroud 110 has tabs 828 for inserting into corresponding slots 330 in the top face 306 of the cassette body 300. Three tabs 828 are shown, but it will be appreciated that any suitable number of tabs could be used. The assembled lock shroud 110 is shown in FIG. 1. The lock shroud 110 prevents a user from inserting an object, for example a wire, up inside the dispenser 100 and hooking a ligature around the locking mechanism 108.

Figure 9:
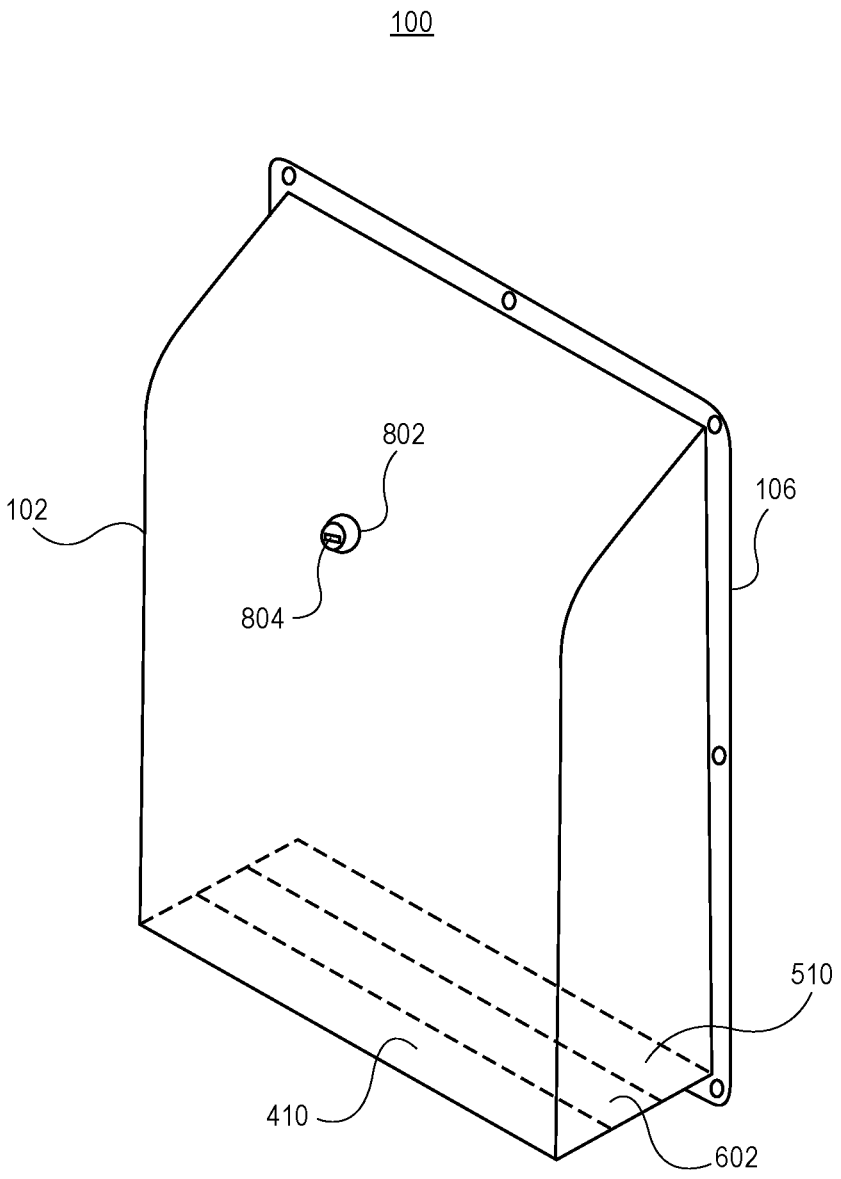
FIG. 9 shows an assembled hand towel dispenser according to the present disclosure.

FIG. 9 shows the assembled hand towel dispenser 100. When assembled, the only visible and accessible parts of the dispenser 100 are the cover 102, an outer portion of the mounting plate 106, the base portions 410, 510 of the first and second cassette lips 400, 500, the opening 602, the lock head 802 and the keyhole 804. The base portions 410, 510 of the first and second cassette lips 400, 500, the opening 602, are accessible from the underside of the hand towel dispenser 100 and shown in dashed lines in FIG. 9. The base portions 410, 510 provide a sealed underside of the dispenser 100. As the edges of the cover 102 are folded and the edges of the mounting plate 106 and the lock head 802 are chamfered, it is very difficult for a patient to attach a ligature to the external features of the hand towel dispenser 100. As the retaining portions 408, 508 of the first and second cassette lips 400, 500 are disposed at an angle to their respective base portions 410, 510, should a ligature be inserted into the cassette assembly 106 via the opening 602, it will slide down the retaining portions 408, 508 and out of the cassette assembly 106. This helps to provide a hand towel dispenser 100 with a reduced ligature risk.

All parts are preferably formed of stainless steel, although other suitable materials could also be used, such as acrylic or mild steel. The joining of edges when forming the cover 102, the cassette body 300 and the lock shroud 110 is preferably performed by welding. Other joining mechanisms known in the art, such as gluing, could also be used. The use of folding and welding to provide the assembled cover 102, the cassette body 300 and the lock shroud 110 provides smooth edges and reduces the presence of features of the dispenser 100 that could be used to attach a ligature. Further, any remaining sharp edges on the dispenser 100 may be softened to reduce the ligature risk. The dispenser 100 is suitable for dispensing different types of hand towel, for example paper towels and tissues, which may be folded for dispensation, as known in the art.

The invention claimed is:

1. An apparatus for storing hand towels, the apparatus comprising:

a cassette assembly comprising a receiving portion for receiving hand towels, a first retaining member, and a second retaining member; and a cover for covering the cassette, the cassette configured to slide relative to the cover between a closed position within the cover, and an open position for filling with hand towels; wherein the first retaining member comprises a first retaining portion, and a base portion for providing a sealed underside of the apparatus, wherein the base portion is formed integrally with the first retaining portion of the first retaining member, the first retaining portion defining a first retaining surface for retaining the hand towels within the receiving portion;

the second retaining member comprises a second retaining portion, the second retaining portion defining a second retaining surface for retaining the hand towels within the receiving portion;

one of the first or second retaining members defines an opening for providing access to the hand towels; and an angle between the first and second retaining surfaces is less than 80 degrees.

2. The apparatus as defined in claim 1, wherein the cassette comprises an opening for receiving towels in the receiving portion.

3. The apparatus as defined in claim 1, wherein the first and second retaining members are disposed within the cassette.

4. The apparatus as defined in claim 1, further comprising a locking mechanism configured to retain the cassette in the closed position.

5. The apparatus as defined in claim 1, wherein the cassette comprises a cut out for receiving a latch of the locking mechanism.

6. The apparatus as defined in claim 1, wherein an edge between the base portion and the first retaining portion defines the opening for providing access to the hand towels.

7. The apparatus as defined in claim 1, further comprising a mounting plate for mounting the hand towel dispenser to a wall.

8. The apparatus as defined in claim 1, wherein at least one of the first retaining member and the second retaining member is formed by folding a flat sheet.

9. The apparatus as defined in claim 1, wherein the angle between the first and second retaining surfaces is between 60° and 150°.

10. The apparatus as defined in claim 9, wherein the angle between the first and second retaining surfaces is 90°.

11. The apparatus as defined in claim 1, wherein the first retaining member comprises at least one locating surface for mating with the cover.

12. The apparatus as defined in claim 11, wherein the at least one locating surface is disposed at an obtuse angle to the retaining surface of the first retaining member.

* * * * *